United States Patent [19]

Rockrohr

[11] Patent Number: 4,581,563

[45] Date of Patent: Apr. 8, 1986

[54] VARIABLE FORMAT CONTROLS CRT RASTER

[75] Inventor: James D. Rockrohr, Kingston, N.Y.

[73] Assignee: International Business Machines Corporation, Armonk, N.Y.

[21] Appl. No.: 555,751

[22] Filed: Nov. 28, 1983

[51] Int. Cl.[4] ..... H01J 29/70; H01J 29/72

[52] U.S. Cl. ..... 315/388; 315/393

[58] Field of Search ..... 315/387, 388, 371, 395, 315/393, 403; 358/180

[56] References Cited

U.S. PATENT DOCUMENTS

| | | | |
|---|---|---|---|
| 3,970,894 | 7/1976 | Yasuda et al. | 315/387 |
| 4,002,824 | 1/1977 | Petrocelli et al. | 358/180 |
| 4,004,190 | 1/1977 | Simpson | 315/403 |
| 4,309,640 | 1/1982 | Gordon | 315/371 |
| 4,414,494 | 11/1983 | Schmidt | 315/387 |

*Primary Examiner*—Theodore M. Blum
*Assistant Examiner*—Gregory C. Issing
*Attorney, Agent, or Firm*—James E. Murray

[57] ABSTRACT

Feedback loops monitor the vertical and horizontal deflection yoke drive voltages of the CRT and separately compare each potential with a voltage which represents full screen deflection. Error voltage resulting from these comparisons adjust the power supplied the yoke to maintain full scale deflection with variations in the frequencies of the vertical sweep or horizontal sync pulses. The feedback loops can be made interdependent so that the smaller one of the two drive potentials determines the size of both drive potentials. In this way the aspect ratio will be maintained irrespective of the changes in the format presented on the screen.

1 Claim, 10 Drawing Figures

(A)

(B)

(C)

IBM (D)

IBM (E)

IBM

VARIABLE FORMAT CONTROLS CRT RASTER

BACKGROUND OF THE INVENTION

The present invention relates to alpha-numeric cathode ray tube (CRT) displays. More particularly, it relates to such a display where a number of different formats can be presented on the screen.

With the introduction of programmable CRT controller modules (CRTC's) flexibilty has been given to CRT display screen formatting. The number of characters per row, the rows per screen etc. can all be changed at any time by the display operator. When there is such a change in the CRTC will generate the required addresses for the display buffer memory and the synchronizing pulses for the CRT analog drive circuits to attain the new display format selected by the operator. Presently used analog CRT display circuits are not really suitable for variable display formating. Those display circuits were adapted from similar circuits used in television monitors where their use was limited to a fixed display format and as a result changes in the format of the display cause undesirable changes in what appears on the screen. For instance, when the number of characters on a line is reduced, letters will become broad while increasing the number of lines on the screen will result in narrower letters. Furthermore, variations in frequency of horizontal synchronizing pulses affects the width of the display frame so that part of the data will be off screen without operator adjustment of the display. Vertical synchronizing pulses are also frequency sensitive and can also require operator display adjustment.

THE INVENTION

Therefore, in accordance with the present invention, infinite variations in the formatting are accomplished without requiring operator intervention to adjust the display. Feedback loops monitor the vertical and horizontal deflection yoke drive voltage of the CRT and separately compare each potential with a voltage which represents full screen deflection. Error voltages resulting from these comparisons adjust the power supplied to the vertical and horizontal deflection yokes to maintain full scale deflection with variations in the frequencies of the vertical sweep or horizontal sync pulses. The feedback loops can be made interdependent so that the smaller one of the two drive potentials determines the size of both drive potentials. In this way the aspect ratio of the displayed characters will be maintained irrespective of the changes in the format presented on the screen.

Therefore it is an object of the present invention to provide controls that maintain the correct character aspect ratio in a CRT display.

It is another object of the present invention to provide display controls that operate without operator or software intervention.

It is a further object of the present invention to provide automatic aspect ratio controls that are transparent to logic circuit used with the displays.

It is also an object of the present invention to provide CRT display tube control circuits that respond to display format changes in desired manners.

THE DRAWINGS

These and other objects of the invention can best be understood with reference to the accompanying figures of which:

FIGS. 1*a–e* show effects of changing the number of characters per line or lines per page on the aspect ratio of the characters in a CRT display;

DETAILED DESCRIPTION

Figure 1:
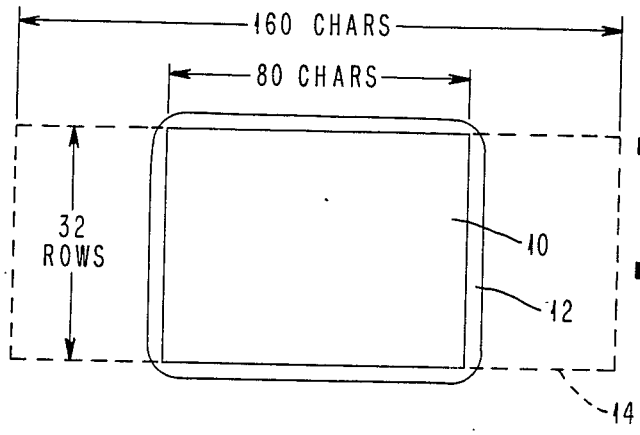
Figure 1:
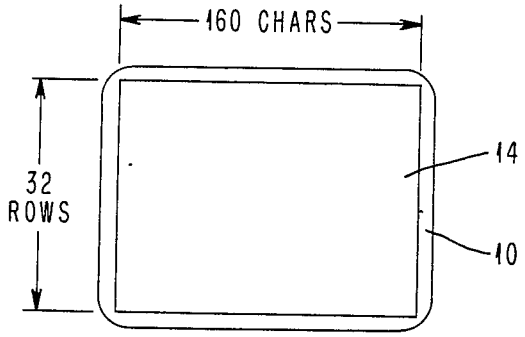
Figure 1:
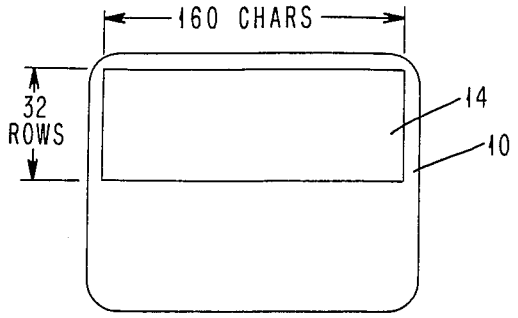
Figure 1:
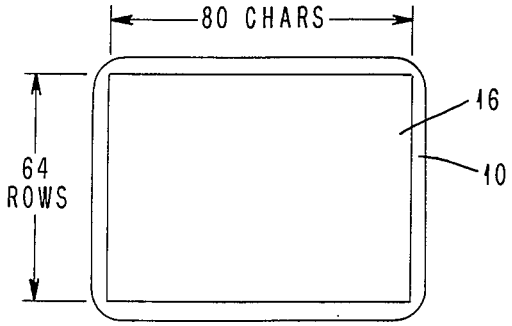
Figure 1:
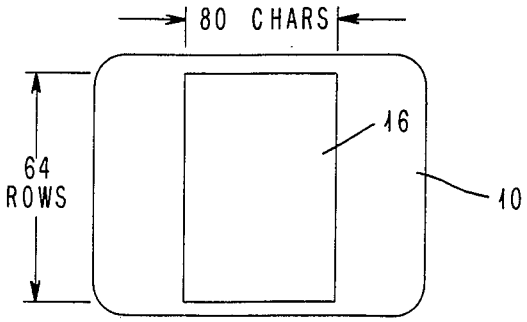

FIG. 1*a* shows a standard data display format 10 of 32 rows of 80 characters on a normal rectangular CRT display screen 12 with a 4 to 3 width to height ratio. Standard IBM characters (7×9 pel capital letters) are shown alongside the display in FIG. 1*a*. The dotted line 14 in FIG. 1*a* shows that doubling the number of characters while maintaining the 7 to 9 aspect ratio of the characters results in half of the characters ending up off the face of the screen. FIG. 1*b* shows that placing all characters in the modified format 14 on the face of the display tube leads to elongated characters. FIG. 1*c* shows a more desirable result where the effect of the format change in the characters is equal in both dimensions. FIG. 1*d* shows that doubling the number of rows in the display without aspect ratio correction results the characters appearing squat. With correction, they appear more normal (FIG. 1*e*).

Figure 2:
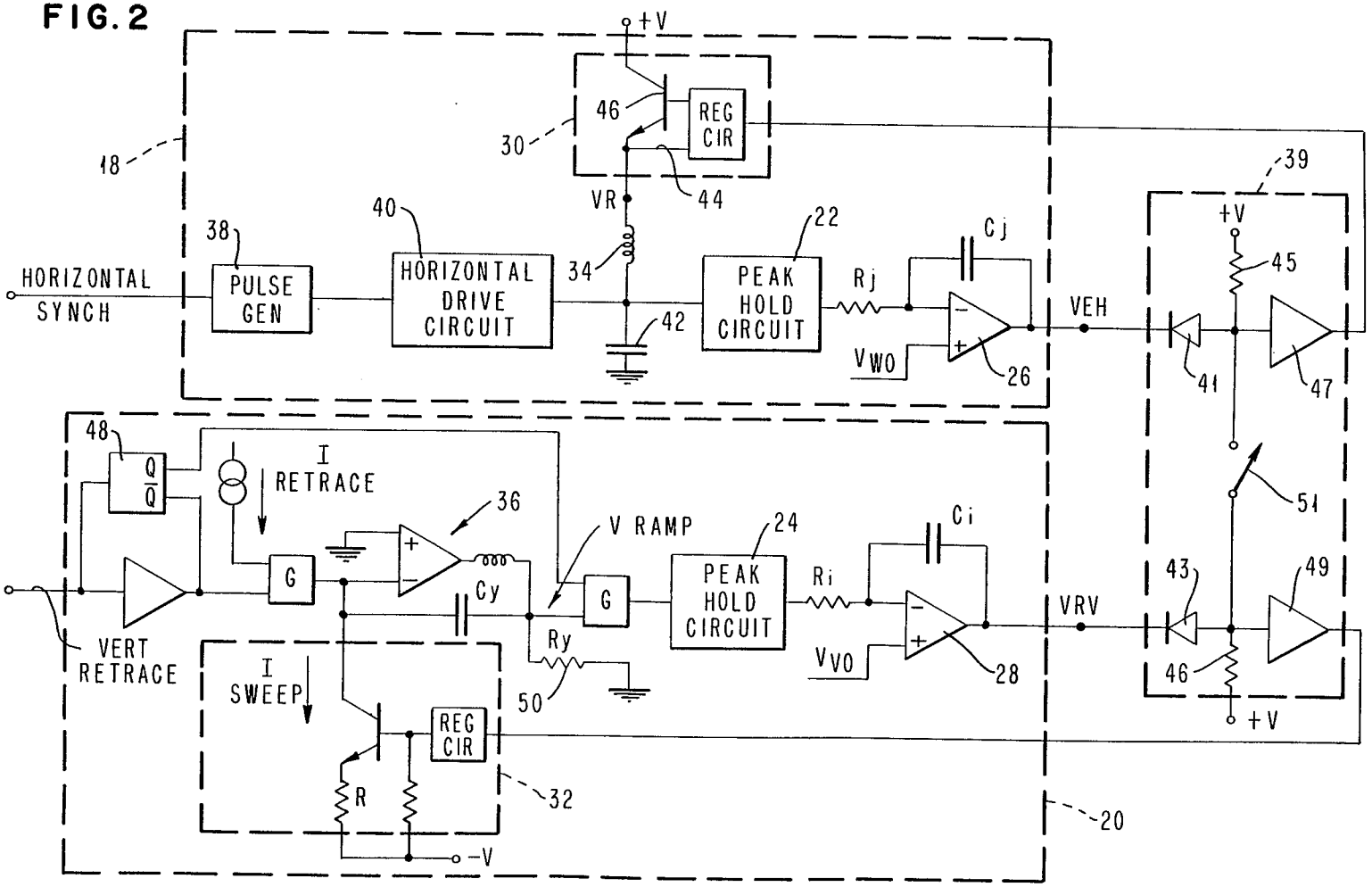
FIG. 2 is a block diagram of CRT vertical and horizontal deflection circuits incorporating the present invention.

In accordance with the present invention, control is provided which adjusts the screen size in response to changes in format to maintain the desired aspect ratio of the characters displayed as shown in FIGS. 1*c* and 1*e*. As shown in FIG. 2, the horizontal deflection circuit 18 and the vertical deflection circuit 20 each have a feedback circuit which includes, a peak detect and hold circuit 22 or 24, an error and reference amplifier 26 or 27 and a source regulator 30 or 32. The source regulator 30 in the horizontal control circuit 18 is a regulated voltage source for the horizontal deflection yoke 34 and the source regulator 32 in the vertical sweep circuit 20 is a variable sweep rate current source for the vertical sweep generator 36.

Figure 3:
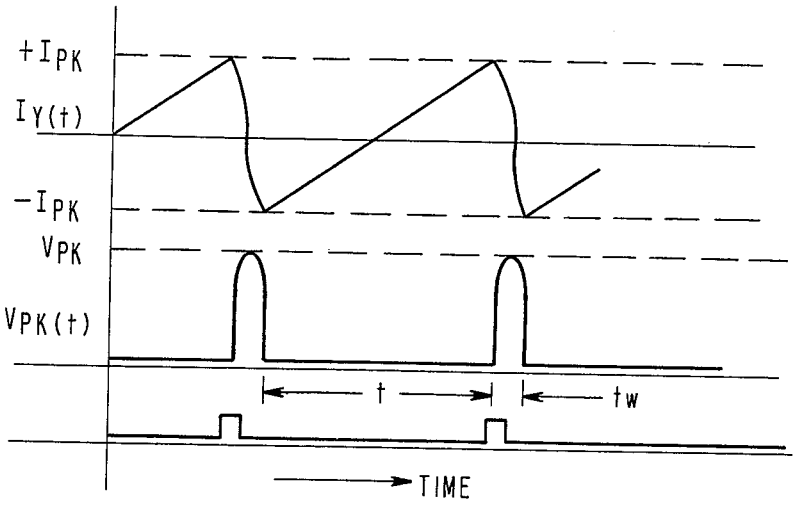
FIG. 3 is response curve of the horizontal deflection circuit shown in FIG. 2.

As shown in FIGS. 2 and 3, the pulse generator circuit 38 detects the horizontal sync input from the CRTC and triggers the drive circuits 40 to initiate flyback by unshorting the flyback capacitor 42. The energy build-up in the inductance, $L_y$ of the yoke 34, during the previous cycle ($E_1=\frac{1}{2}\ L_yI_y^2$) is now dumped into the flyback capacitor 42, ($E_c=\frac{1}{2}\ C_fV_f^2$) which, in turn, dumps it back to the yoke 34 as a current of the opposite polarity where it's again clamped by the drive circuits 40 in typical prior art resonant flyback system fashion. The voltage across capacitor 42 during flyback is a sinusoidal pulse whose peak amplitude is approximately:

$$Vpk = Ipk\sqrt{\frac{L_y}{C_f}} \quad \text{(Eqn. 1)}$$

and whose pulse width is:

$$t_w = \pi \times \sqrt{L_y \times C_f} \quad \text{(Eqn. 2)}$$

where

Vpk = peak voltage on $C_f$ in volts,

Ipk = peak current in $L_y$ at the instant flyback starts in amperes, $L_y$ = deflection yoke inductance in henries, $C_f$ = flyback capacitance in farads, $t_w$ = flyback pulse width in seconds, and $\pi$ = pi (3.14159).

Since the raster width is proportional to the peak deflection coil current, Ipk, from equation (1), it should be apparent that the peak flyback pulse voltage Vpk is also proportional to the raster width.

The peak detect and hold circuit 22 samples and holds the peak flyback voltage, Vpk, so that it is then compared in integrator 26 to a reference potential Vwo which is equal to a peak voltage that causes full screen width deflection. The error voltage output Veh of integrator 26 that results from this comparison is fed through diode 41 and buffer amp 47 to the width regulator 30. The width regulator 30 is a simple series pass regulator with feedback 44 which regulates voltage $V_R$ through transistor 46 to maintain the peak flyback voltage Vpk equal to the reference potential Vwo.

The error integrator 26 has a time constant Rj×Cj equal to at least three times the slowest time constant in the horizontal control loop (usually in width regulator 30) to avoid loop instability. An error integrator is used instead of a simple amplifier to achieve a high, stable loop gain to reduce the error voltage and improve accuracy of the circuit.

Horizontal raster width is proportional to deflection coil current Iy. This current is proportional to the applied voltage and time:

$$I_y(t) = \frac{1}{L_y}\int_0^{tmax} Vr \times dt + I_y(0) \quad \text{(Eqn. 3)}$$

where $I_y(t)$ = deflection coil current at time t, $L_y$ = deflection coil inductance, Vr = applied D.C. voltage, $I_y(0)$ = deflection coil current at time zero. (Typically $I_y(0) = -I_y(tmax)$ when losses due to winding resistance and core heating are neglected, which can be done in this approximate analysis.), dt = differential with respect to time, tmax = time between flyback pulses.

Therefore, raster size is proportional to the applied voltage, Vr, and the time, tmax, between flyback pulses, Vpk. Since the addition of the peak detect and hold circuit 22 and error integrator 26 has given us automatic regulation of width by controlling Vr, the period tmax of the horizontal drive pulses can now vary over a wide range and the raster size will be maintained as Vr will automatically change to compensate for changes in tmax.

Figure 4:
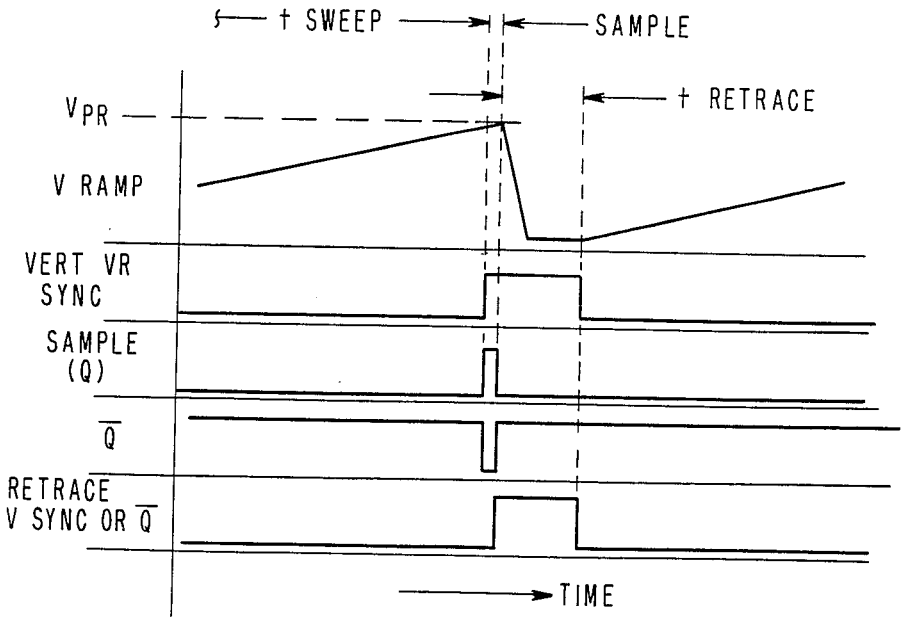
FIG. 4 is response curves for the vertical deflection circuit shown in FIG. 2.

As shown in FIGS. 2 and 4, the vertical retrace circuits utilize an integrator amplifier 36 to generate the necessary linear ramp current, Vramp, to determine the beam position. Vertical retrace pulse from the CRTC initiates vertical retrace. The leading edge of the vertical retrace pulse causes trigger circuit 48 to generate a sample pulse Q which gates the sample and hold circuit 24 on for a period to sample the retrace voltage across resistor 50. The vertical sync is delayed by the $\overline{Q}$ output of that same trigger circuit 48 before being fed to initiate retrace. The sample and hold circuit now has an output Vpk that corresponds to the $V_{ramp}$ voltage just before retrace was started.

This output voltage Vpk of the peak hold circuit 24 is compared to a pre-set reference potential Vvo which represents full-screen vertical deflection. The error voltage output of error integrator 28 that results from this comparison is fed through diode 43 and buffer amp 49 to the regulated current source 32 to maintain the peak of $V_{ramp}$ equal to $V_{vo}$. Regulated current source 32 is a circuit that generates a current, $I_{sweep}$, proportional to its input voltage. This current is applied to integrator amplifier 36 to control the slope of $V_{ramp}$. If Vpk is too high, $I_{sweep}$ is reduced, and vice versa altering $V_{ramp}$ proportionately. An error integrator 28 is used in place of a simple amplifier in order to achieve a high, stable loop gain to reduce the error voltage and improve the accuracy of the circuit. The error integrator has a time constant, $R_i \times C_i$, that is at least 3 times the expected maximum (slowest) sweep time to avoid loop instability due to over-correction between samples.

Vertical raster height is proportional to deflection coil current $I_y$. This current is proportional to $I_{sweep}$ and time:

$$I_y(t) = \frac{1}{R_y C_y}\int_0^{tmax} I_{sweep} \times dt + I_y(0)$$

where $I_y(t)$ = deflection coil current at time t, $C_y$ = integrator amplifier capacitor, $R_y$ = deflection coil current sample resistor 50, $I_{sweep}$ = applied sweep current, dt = differential with respect to time, $I_y(0)$ = deflection coil current at time zero. (Typically $I_y(0) = -I_y(t)$)

tmax = time between vertical retrace pulses.

Therefore, raster size is proportional to the applied current, $I_{sweep}$, and the time, tmax, between vertical retrace pulses. Since the addition of the peak detect and hold circuit 24 and error integrator 28 has given us automatic regulation of height by controlling $I_{sweep}$, the period tmax of the vertical retrace pulses can now vary over a wide range and the raster size will be maintained as $I_{sweep}$ will automatically change to compensate for changes in tmax.

What has been described is the circuits for a standard full screen format of 80 characters in a row and 32 rows per screen. Suppose that the CRTC is re-programmed to put out only one-half as many characters per line by doubling the frequency of the horizontal sync pulse. Then the flyback voltage Vpk will decrease and the feedback circuit will cause Vr to increase until Vpk again equals Vwo or Veh = 0. As a result, the 40 characters will fill the display screen and the aspect ratio of the characters will become 14 to 9 instead of 7 to 9. If the aspect ratio circuit 39 is switched into operation via switch 51, this will not occur. The resistors 45 and 46 and two diodes 41 and 43 in the aspect ratio circuitry 39 performs a "diode-or" function of the two control signals allowing only the lowest of the two feedback error voltages Vev or Veh to affect both controlled sources 30 and 32 in the same manner to keep the vertical and horizontal pel spacings equal. The buffer amps 47 and 49 equalize the gain and offsets in the two feedback loops so that Veh and Vev induce equivalent changes in picture size in both the horizontal and vertical directions.

If the horizontal time periods tmax are reduced as described above the horizontal error voltage $V_{eh}$ will become higher than the vertical error voltage $V_{ev}$ and back bias diode 41 preventing feedback compensation in the horizontal drive circuit and force a reduction in the horizontal size of the displayed frame. In this way, the aspect ratio control circuit 39 assures that the largest image that will fit on the screen with the correct aspect ratio will be presented.

Figure 5:
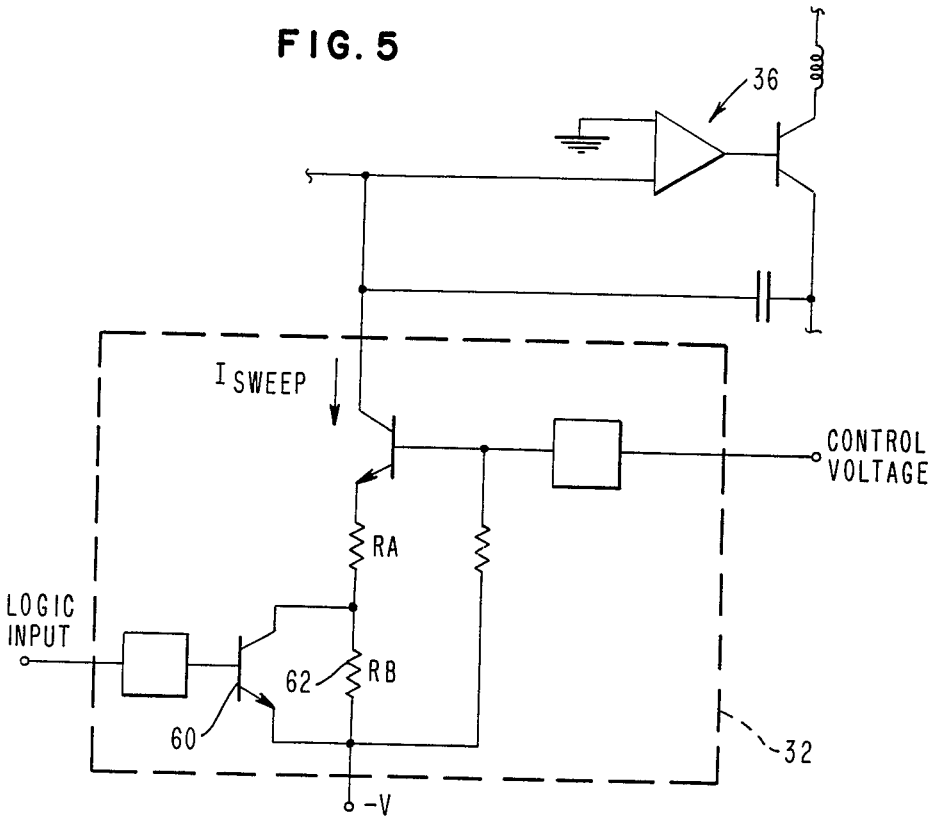
FIG. 5 is a circuit to achieve a multiple format display that can be incorporated in the system shown in FIG. 2.
Figure 6:
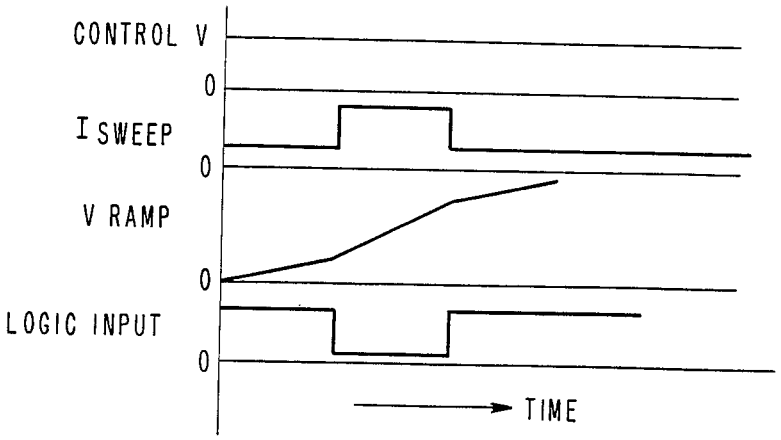
FIG. 6 is a series of curves showing operation of Circuit in FIG. 5.

The circuit in FIG. 5 is for increasing the vertical height of rows of characters on a portion of the display that is of interest (2 or 3 rows around cursor). It shows a substitute for the vertical sweep current source 32 of FIG. 2. When transistor 60 is off (logic input high) the new sweep circuit source 32 behaves as the sweep current source 32 described in FIG. 2. However, when the logic input to transistor 60 is low, transistor 60 turns on shorting out resistor 62 and doubling "$I_{sweep}$" ("RA"="RB" and both equal ½"R" in FIG. 2). As shown in FIG. 6, this in turn doubles the slope of the ramp Vramp causing the beam to sweep twice as fast, thus doubling the character height. When the logic input is again high, "$I_{sweep}$" and the character height return to normal. Since the response of the automatic circuits in FIG. 2 are slow with respect to the logic input signal described here (several seconds vs. tens of milliseconds) the overall operation of the automatic height circuits will cause the overall raster height to remain constant. The result appears to the operator as a magnified area within the character display with no loss of the original data. The unmagnified characters get slightly smaller to make room for the magnified characters.

Above a single embodiment of the invention and one possible modification thereof has been described. However it should be understood that many modifications and changes can be made in the described embodiment without departing from the spirit and scope of the invention as represented by the attached claims.

Having thus described our invention, what we claim as new and desire to secure by Letters Patent is:

1. In a CRT display with a vertical ramp circuit and a horizontal deflection circuit for the deflection yokes of the CRT, an improved control means for regulating the size of images displayed on the screen in response to changes in frequency of the horizontal sync and vertical sweep pulses comprising:

first feedback means for comparing the size of drive pulses for the horizontal yoke with a reference and adjusting the power supplied to the horizontal deflection circuit on the basis of this first comparison;

second feedback means for comparing the maximum vertical ramp potential with a reference and adjusting the power supplied to the ramp circuit on the basis of this second comparison; and interconnection means for coupling the first and second feedback means together so that the smaller of the two mentioned error signals controls the power supplied to both the horizontal deflection circuit and the vertical ramp circuit whereby the aspect ratio of the characters displayed on the CRT display is maintained irrespective of changes in the format presented on the display.

* * * * *